US007998576B2

(12) United States Patent
Abe et al.

(10) Patent No.: US 7,998,576 B2
(45) Date of Patent: Aug. 16, 2011

(54) RADIOPAQUE MONOFILAMENT FOR CONTRAST X-RAY RADIOGRAPHY

(75) Inventors: Seiji Abe, Kyoto (JP); Kenji Chizuka, Kyoto (JP); Shoji Matsumoto, Kyoto (JP); Koji Kakumoto, Kyoto (JP); Takenori Domon, Kyoto (JP); Dai Iwasaki, Kyoto (JP)

(73) Assignee: Unitika Ltd., Hyogo (JP)

( * ) Notice: Subject to any disclaimer, the term of this patent is extended or adjusted under 35 U.S.C. 154(b) by 0 days.

(21) Appl. No.: 12/865,285

(22) PCT Filed: Nov. 7, 2008

(86) PCT No.: PCT/JP2008/003223

§ 371 (c)(1),
(2), (4) Date: Jul. 29, 2010

(87) PCT Pub. No.: WO2009/101661

PCT Pub. Date: Aug. 20, 2009

(65) Prior Publication Data

US 2010/0329417 A1 Dec. 30, 2010

(30) Foreign Application Priority Data

Feb. 15, 2008 (JP) ..... 2008-034571

(51) Int. Cl.
*D02G 3/00* (2006.01)

(52) U.S. Cl. ..... 428/372; 51/298; 428/370; 428/373; 428/374

(58) Field of Classification Search ..... 428/364, 428/372, 373, 374, 370; 51/298
See application file for complete search history.

(56) References Cited

U.S. PATENT DOCUMENTS

| | | | | |
|---|---|---|---|---|
| 6,027,803 | A * | 2/2000 | Jacobson et al. | 428/372 |
| 6,352,471 | B1 * | 3/2002 | Bange et al. | 451/527 |
| 7,763,351 | B2 * | 7/2010 | Vedula et al. | 428/364 |
| 7,799,255 | B2 * | 9/2010 | Vedula et al. | 264/178 R |
| 2006/0008643 | A1 * | 1/2006 | Lin et al. | 428/364 |
| 2006/0135699 | A1 * | 6/2006 | Li et al. | 525/240 |
| 2007/0172526 | A1 * | 7/2007 | Galdonik et al. | 424/484 |
| 2008/0114703 | A1 * | 5/2008 | Dahlberg et al. | 705/36 R |
| 2008/0227919 | A9 * | 9/2008 | Li et al. | 525/240 |
| 2009/0302241 | A1 * | 12/2009 | Abe et al. | 250/519.1 |
| 2009/0326114 | A1 * | 12/2009 | Grothe et al. | 524/148 |
| 2010/0035045 | A1 * | 2/2010 | McAmish | 428/323 |
| 2010/0098948 | A1 * | 4/2010 | Nakanishi | 428/391 |
| 2010/0173547 | A1 * | 7/2010 | Katayama et al. | 442/1 |
| 2010/0329417 | A1 * | 12/2010 | Abe et al. | 378/28 |

FOREIGN PATENT DOCUMENTS

| | | |
|---|---|---|
| JP | 2000-336521 | 12/2000 |
| JP | 2002-238943 | 8/2002 |
| JP | 2002-266157 | 9/2002 |
| JP | 2004-162239 | 6/2004 |
| JP | 2006-51209 | 2/2006 |
| JP | 2007-138358 | 6/2007 |
| JP | 2007-238914 | 9/2007 |
| JP | 2008-303525 | 12/2008 |
| WO | 2006/115266 | 11/2006 |

* cited by examiner

*Primary Examiner* — N. Edwards
(74) *Attorney, Agent, or Firm* — Fildes & Outland, P.C.

(57) ABSTRACT

Disclosed is a monofilament allowing contrast X-ray radiography. At least part of the monofilament is formed of a thermoplastic resin containing a radiopaque agent. The monofilament contains the radiopaque agent in the thermoplastic resin in a content of 30 to 80% by mass, and has a Young's modulus of 0.1 to 5.0 cN/dtex and a fineness of 500 to 20000 dtex.

4 Claims, No Drawings

RADIOPAQUE MONOFILAMENT FOR CONTRAST X-RAY RADIOGRAPHY

TECHNICAL FIELD

The present invention relates to a monofilament allowing contrast X-ray radiography wherein the monofilament has an X-ray contrast capability due to a radiopaque agent contained therein.

BACKGROUND ART

Recently, development of medical materials capable of performing contrast X-ray radiography has been demanded.

For example, a hollow fiber or a hollow monofilament containing a contrast agent in the hollow portion thereof has been proposed. It has been proposed to use the hollow fiber or the hollow monofilament as formed into a braided cord shape, or to obtain various medical materials such as pins in bone fixation materials by chopping the hollow fiber or the hollow monofilament into short fibers (JP2000-336521A).

JP2002-266157A describes an X-ray sensitive fiber composed of a thermoplastic resin containing a radiopaque agent, and also describes the use of this X-ray sensitive fiber as woven into part of surgical gauze or the like.

By using X-ray contrasting threads in part of the fibers constituting the gauze fabric, such surgical gauze is made discernible when left in the body. However, such surgical gauze left in the body is frequently made hardly accessible by contrast X-ray radiography due to the various organs and body fluids. Accordingly, as the X-ray contrasting thread, threads having higher contrast capability are demanded. Further, surgical gauze may be brought into direct contact with the skin or the organ of an affected part or the like, and hence surgical gauze is demanded to have flexibility exhibiting soft texture.

However, the fiber proposed in JP2000-336521A uses general-purpose polymers such as nylon and polypropylene. Therefore, the obtained hollow fibers lack in flexibility and cause inconvenience when used as woven into part of surgical gauze or the like.

The fiber described in JP2002-266157A has a moderate content of a radiopaque agent, and hence has not yet attained a sufficient X-ray contrast performance.

JP2004-162239A proposes a monofilament, with a styrene elastomer used therein, allowing contrast X-ray radiography. This monofilament is capable of improving the operability through specifying the resin hardness. However, with the hardness described in JP2004-162239A, no sufficient flexibility is obtained. Therefore, the monofilament proposed in JP2004-162239A is not suitable for being woven into part of surgical gauze or the like.

DISCLOSURE OF THE INVENTION

Problems to be Solved by the Invention

A technical subject of the present invention is to solve such problems as described above, and to thereby provide a monofilament allowing contrast X-ray radiography, having excellent X-ray contrast performance, being suitable for insertion into woven fabrics, non-woven fabrics and the like because the monofilament is flexible, and in particular, being suitably usable for surgical gauze.

Means for Solving the Problems

The present inventors made a study in order to solve the above-described problems, and consequently have reached the present invention.

The monofilament allowing contrast X-ray radiography of the present invention is a monofilament wherein at least part of the monofilament is formed of a thermoplastic resin containing a radiopaque agent, the monofilament contains the radiopaque agent in the thermoplastic resin in a content of 30 to 80% by mass, and has a Young's modulus of 0.1 to 5.0 cN/dtex and a fineness of 500 to 20000 dtex.

ADVANTAGES OF THE INVENTION

The monofilament allowing contrast X-ray radiography of the present invention is excellent in X-ray contrast capability and is also flexible, and hence is suitable for being used as inserted into woven fabrics, nonwoven fabrics or the like. Consequently, woven or knitted fabrics, non-woven fabrics or the like having as inserted therein the monofilament allowing contrast X-ray radiography of the present invention are particularly suitably usable as surgical gauze, and in the case of being used as surgical gauze, surgical gauze having soft texture is offered.

BEST MODE FOR CARRYING OUT THE INVENTION

Hereinafter, the present invention is described in detail.

The monofilament of the present invention is formed of a thermoplastic resin containing a radiopaque agent. However, in general, when an inorganic compound as a radiopaque agent is contained in the thermoplastic resin, the monofilament tends to be poor in flexibility. Accordingly, in the present invention, it is preferable to use as the thermoplastic resin containing a radiopaque agent a thermoplastic resin that permits application of melt spinning and maintains flexibility even when the radiopaque agent is contained in the thermoplastic resin in a high concentration; it is preferable to use a thermoplastic elastomer, among others.

Examples of the thermoplastic elastomer include a polyester elastomer, a polyamide elastomer, a polyolefin elastomer, a polyurethane elastomer and a polystyrene elastomer. Examples of the thermoplastic elastomer may also include copolymers and mixtures composed of these elastomers as components.

Preferable among these is the polyester elastomer, and examples of the polyester as the hard segment include polyalkylene terephthalates such as polyethylene terephthalate, polytrimethylene terephthalate and polybutylene terephthalate. Examples of the soft segment include a polyether, a polybutylene adipate ester and a polyol.

In the thermoplastic resin containing a radiopaque agent therein in the present invention, as described below, the durometer hardness according to the JIS K6253 method is further preferably less than D70 in the case of a single-component type and less than D60 in the case of a core-sheath type. Resins obtained by kneading two or more resins may also be used in addition to single-component resins. For example, when with a thermoplastic elastomer having a durometer hardness of less than D70 or less than D60, a thermoplastic elastomer having a high melting point is kneaded, the deterioration of the obtained monofilament is suppressed in the high temperature treatment (for example, a treatment in boiling water or an alkali aqueous solution at 130° C.) at the time of the refining or the bleaching of woven or knitted fabric or non-woven fabric, while the Young's modulus (flexibility) of the monofilament is being kept satisfactory.

As long as the advantageous effects of the present invention are not impaired, the following additives can be added to the thermoplastic resin, where necessary: a heat stabilizer, a crystal nucleating agent, a delustering agent, a pigment, an antiweathering agent, a light resistant agent, a lubricant, an antioxidant, an antibacterial agent, a fragrance, a plasticizer, a dye, a surfactant, a flame retardant, a surface modifier, various inorganic and/or organic electrolytes and other additives.

As the radiopaque agent contained in the thermoplastic resin, barium sulfate, bismuth subnitrate, tungsten oxide, thorium oxide, cesium oxide and the like can be used. Preferable among these is barium sulfate. Barium sulfate is excellent in radiopacity, and high in heat resistance and crystal stability. Further, barium sulfate permits easy production of particles which are small in primary particle size and hardly undergo secondary agglomeration, and hence when barium sulfate is kneaded into a thermoplastic resin and then the thermoplastic resin is subjected to melt spinning, no increase of the filtration pressure and no thread breakage occur, and thus fibers can be obtained with a satisfactory operability.

The particle size of the radiopaque agent is preferably moderately large from the viewpoint of improving the contrasting capability, a too large particle size of the radiopaque agent is unfavorable from the viewpoint of uniform dispersion of the radiopaque agent in the fiber, and conversely, a too small particle size leads to a problem of occurrence of the secondary agglomeration. In consideration of the above-described points, the average primary particle size of the radiopaque agent is preferably 0.5 to 10 μm, more preferably 0.8 to 8 μm and particularly preferably 1.0 to 5 μm.

When the monofilament allowing contrast X-ray radiography is used for surgical gauze or the like, a higher contrast performance is demanded as described above. Accordingly, in the monofilament allowing contrast X-ray radiography of the present invention, the content of the concerned radiopaque agent in the thermoplastic resin containing the radiopaque agent is required to be 30 to 80% by mass, and is preferably 40 to 80% by mass and more preferably 65 to 75% by mass.

When the content of the radiopaque agent is less than 30% by mass, the contrast performance of the monofilament is poor. On the other hand, when the content of the radiopaque agent exceeds 80% by mass, the monofilament is hard and poor in flexibility, and the yarn-making operability of the monofilament is degraded.

The fineness of the monofilament allowing contrast X-ray radiography is also a factor that affects the contrasting capability. Accordingly, the fineness of the monofilament allowing contrast X-ray radiography of the present invention is set at 500 to 20000 dtex. When the fineness is less than 500 dtex, the monofilament is too fine and consequently the contrast performance of the monofilament is poor. On the other hand, when the fineness exceeds 20000 dtex, the monofilament is thick and poor in flexibility.

The monofilament allowing contrast X-ray radiography of the present invention is required to have a Young's modulus of 0.1 to 5.0 cN/dtex. The Young's modulus is an index indicating the flexibility, and the above-described range or the below-described range can be attained by selecting the type of the thermoplastic resin, by setting the content of the radiopaque agent in the above-described range or the fineness of the monofilament in the above-described range, or by appropriately selecting the production (yarn-making, stretching) conditions.

When the Young's modulus exceeds 5.0 cN/dtex, the monofilament is poor in flexibility. Therefore, when the monofilament is used as inserted into woven or knitted fabrics, non-woven fabrics or the like, the obtained woven or knitted fabrics or non-woven fabrics lack in soft texture, and these fabrics are not suitable for being used as surgical gauze. On the other hand, when the Young's modulus is less than 0.1 cN/dtex, the monofilament may be poor in the yarn-making operability, or the obtained products may be poor in quality.

The Young's modulus is preferably 0.1 to 3.5 cN/dtex, more preferably 0.2 to 2.0 cN/dtex and particularly preferably 0.3 to 1.0 cN/dtex.

The strength and the elongation of the monofilament allowing contrast X-ray radiography of the present invention are appropriately selected in consideration of, for example, the conditions of the insertion into woven or knitted fabrics, non-woven fabrics or the like, or the use conditions of the woven or knitted fabrics, non-woven fabrics or the like after the insertion. The strength and the elongation of the monofilament allowing contrast X-ray radiography of the present invention are capable of being adjusted to appropriate values, for example, by performing the selection of the type of the resin, the selection of the resin blend ratio, and the selection of the yarn-making conditions (the yarn-making speed, the stretching magnification, the content of the X-ray opaque agent and the like).

For the purpose of improving the contrast capability, it is preferable to make circular the cross sectional shape of the monofilament. Among circular shapes, the shapes closer to true circles than to ellipses are preferable. Elliptical shapes are partially shorter with respect to the X-ray transmission path, and hence the contrast performance may be poor. On the contrary, true circles are free from such portions that make shorter the X-ray transmission path and hence such true circles lead to particularly excellent contrast performance.

At least part of the monofilament allowing contrast X-ray radiography of the present invention is formed of a thermoplastic resin containing a radiopaque agent. Examples of the monofilament having such structure include a single-component monofilament composed only of a thermoplastic resin containing a radiopaque agent, and a composite monofilament composed of a thermoplastic resin containing a radiopaque agent and another thermoplastic resin containing no radiopaque agent. Examples of the composite monofilament include a core-sheath monofilament in which the core portion is formed of a thermoplastic resin containing a radiopaque agent and the sheath portion is formed of a thermoplastic resin containing no radiopaque agent, a side-by-side type monofilament in which a thermoplastic resin containing a radiopaque agent and a thermoplastic resin containing no radiopaque agent are bonded to each other, and a sea-island type monofilament in which a thermoplastic resin containing a radiopaque agent is present as island portions in a thermoplastic resin containing no radiopaque agent.

Among these monofilaments, the monofilament allowing contrast X-ray radiography of the present invention is preferably the single-component monofilament and the core-sheath monofilament.

<Single-component Monofilament>

The monofilament allowing contrast X-ray radiography of the present invention includes a thermoplastic resin containing a radiopaque agent, and for the purpose of improving the contrast capability, it is preferable to increase the proportion of the resin containing a radiopaque agent as added therein. For that purpose, the concerned monofilament is preferably a single-component monofilament including only the thermoplastic resin containing a radiopaque agent.

When a single-component monofilament is adopted, it is preferable for a radiopaque agent to be uniformly dispersed in a thermoplastic resin. For the purpose of uniformly dispersing the radiopaque agent in the thermoplastic resin, it is preferable to knead at the time of melt spinning the radiopaque agent and the thermoplastic resin directly with each other by using an extruder or the like. Alternatively, when a master chip containing the radiopaque agent in a high concentration is once prepared and then the concerned kneading is performed, a more uniform kneading can be performed.

In the single-component monofilament, the durometer hardness according to the JIS K6253 method of the thermoplastic resin containing a radiopaque agent is preferably less than D70; the durometer hardness is more preferably D40 or less and furthermore preferably A80 or less, A80 being further lower in hardness than D40. When the durometer hardness is D70 or more, the obtained monofilament allowing contrast X-ray radiography is hard and poor in flexibility, and is not suitable for being used, for example, for surgical gauze by inserting the monofilament into woven or knitted fabrics, or non-woven fabrics. It is to be noted that when two or more thermoplastic resins are used as kneaded with each other, the durometer hardness obtained after having once compounded these resins is preferably less than D70.

<Core-sheath Monofilament>

The core-sheath monofilament of the present invention is a core-sheath composite monofilament in which the core portion is formed of a thermoplastic resin containing a radiopaque agent and the sheath portion is formed of a thermoplastic resin containing no radiopaque agent.

The core-sheath monofilament of the present invention has a core-sheath composite structure containing a radiopaque agent only in the core portion, and hence the amount of the radiopaque agent in the core portion determines the X-ray contrast capability of the entire composite monofilament. As compared to the single-component monofilament containing the radiopaque agent in the same amount as contained in the core portion, the composite monofilament has a larger fineness. Therefore, for the purpose of making satisfactory the flexibility of the entire monofilament, the flexibility of the thermoplastic resin for the core portion is particularly demanded, and thus the durometer hardness of the thermoplastic resin is important.

The above-described durometer hardness of the thermoplastic resin for the core portion (hereinafter, referred to as the(a) core-portion thermoplastic resin) is preferably less than D60; in particular, the durometer hardness is preferably D30 or less and more preferably A75 or less. When the durometer hardness is D60 or more, the obtained composite monofilament is hard and poor in flexibility, and hence is not suitable for being used, for example, for surgical gauze by inserting the monofilament into woven or knitted fabrics or non-woven fabrics.

It is to be noted that when two or more thermoplastic resins are used as kneaded with each other, the above-described durometer hardness obtained after having once compounded these resins is preferably less than D70.

In the core-sheath monofilament of the present invention, from the viewpoint of, for example, the flexibility of the monofilament and the improvement of the abrasion resistance of the monofilament surface, a thermoplastic resin containing no radiopaque agent is used in the sheath portion. In particular, similarly to the core-portion thermoplastic resin containing a radiopaque agent, it is preferable to use a thermoplastic elastomer for the sheath portion. Alternatively, it is also preferable to use for the sheath portion, for example, a thermoplastic resin excellent in abrasion resistance.

Examples of the thermoplastic resin excellent in abrasion resistance, other than thermoplastic elastomers, include polyamide, polyester and polyolefin. Preferable among these is polyamide. Examples of polyamide include nylon 6, nylon 66, nylon 69, nylon 46, nylon 610, nylon 12 and polymetaxylene adipamide. The thermoplastic resin excellent in abrasion resistance, other than thermoplastic elastomers, may also be copolymers or mixtures composed of these polyamide as components. Particularly preferable among the polyamides are nylon 11, nylon 12 and nylon 610.

The reason for the preference of polyamide as the thermoplastic resin for the sheath portion (hereinafter, referred to as the(a) sheath-portion thermoplastic resin) is such that the polyamide fiber has texture excellent in soft feeling or moist feeling due to the polymer properties and is suitable for medical applications such as surgical gauze brought into contact with affected parts. Among the polyamides, nylon 11, nylon 12 and nylon 610 are small in the melting point difference from the melting point of the resin used for the core portion, in addition to the above-described properties, and hence are satisfactory in operability so as to enable application of melt spinning.

When polyester is used as the sheath-portion thermoplastic resin, examples of the polyester include polyethylene terephthalate (PET), polytrimethylene terephthalate and polybutylene terephthalate. When polyolefin is used, examples of the polyolefin include polypropylene and polyethylene. These polyester and polyolefin components may also be used as copolymers or mixtures composed thereof.

The durometer hardness, according to the JIS K6253 method, of the sheath-portion thermoplastic resin is preferably less than D60. The durometer hardness is more preferably D30 or less, and particularly preferably A75 or less, A75 being further lower in hardness than D30. It is to be noted that when two or more thermoplastic resins are used as kneaded with each other, the above-described durometer hardness obtained after having once compounded these resins is preferably less than D70.

By making the sheath-portion thermoplastic resin and the core-portion thermoplastic resin have comparable flexibilities as described above, the core-sheath monofilament can be a monofilament having soft and flexible texture as a composite monofilament.

For the purpose of preventing the detachment of the core portion and the sheath portion of the monofilament from each other, the core-sheath composite monofilament is preferably a monofilament in which part of the molecular components of the core-portion thermoplastic resin are copolymerized with the sheath-portion thermoplastic resin, or a monofilament in which added is a compatibilizing agent obtained by copolymerizing or block copolymerizing part of the molecular components of the core-portion thermoplastic resin and/or the sheath-portion thermoplastic resin.

For example, when the sheath-portion thermoplastic resin is polyamide, polyester or polyolefin, examples of the core-sheath composite monofilament include monofilaments in each of which with part of the sheath portion component part of the following components constituting the core-portion thermoplastic resin are copolymerized: alkylene terephthalate components such as ethylene terephthalate, trimethylene terephthalate and butylene terephthalate; aromatic dicarboxylic acid components such as isophthalic acid and 5-sulfoisophthalic acid; aliphatic dicarboxylic acid components such as adipic acid, succinic acid, suberic acid, sebacic acid and dodecanedioic acid; polyether components including ethylene glycol and propylene glycol; polybutyl adipate ester components; and polyol components. Alternatively, a compatibilizing agent obtained by copolymerizing or block copolymerizing these components in the molecule thereof can be used.

When a thermoplastic resin excellent in abrasion resistance, other than thermoplastic elastomers, is used as the sheath-portion thermoplastic resin, it is preferable, for the purpose of preventing the degradation of the flexibility of the composite monofilament, to restrict the core-sheath composite ratio within a specified range. In this case, the core-sheath ratio (volume ratio, core/sheath) is preferably 1/1 to 5/1, more preferably 2/1 to 4/1 and furthermore preferably 2.5/1 to 3.5/1. When the proportion of the sheath portion is larger than the ratio 1/1, the soft flexibility of the entire composite monofilament is insufficient, hence the Young's modulus of the monofilament is high, and consequently the monofilament is hardly suitable for being incorporated into part of surgical gauze or the like. On the other hand, when the proportion of the sheath portion is smaller than the ratio 5/1, melt spinning is not conducted satisfactorily, and the operability may be degraded.

As compared to the single-component monofilament composed only of a thermoplastic resin containing a radiopaque agent, a core-sheath composite monofilament contains a radiopaque agent only in the core portion, and hence hardly undergoes the occurrence of the asperities on the surface of the monofilament. Consequently, in the production steps such as melt spinning and winding-up and in the processing step in the production of woven or knitted fabrics or non-woven fabrics, abrasion of guides or the like scarcely occurs, and additionally the core-sheath composite monofilament is free from the occurrence of the fluff, the strength degradation and the texture degradation of the filament itself.

Additionally, the adoption of the core-sheath composite monofilament improves the abrasion resistance of the monofilament surface, and hence provides advantages such that the guides and the like in the production apparatuses and the processing apparatuses are scarcely abraded. Such scarce occurrence of the abrasion of the guides and the like also precludes the occurrence of the fluff, the strength degradation and the texture degradation of the monofilament itself, and thus can lead to a monofilament excellent in quality.

<Production Method>

Next, the method for producing the monofilament allowing contrast X-ray radiography of the present invention is described.

In the case of the single-component type, first a compound resin chip composed of a radiopaque agent and a thermoplastic resin is melted by a heretofore known method by using an extruder, and extruded from a spinneret to perform melt spinning. The spinning temperature is preferably set to fall within a range from (Tm+10)° C. to (Tm+80)° C. in relation to the melting point Tm of the used thermoplastic resin. When the spinning temperature is too high, the thermoplastic resin undergoes thermal decomposition, and smooth spinning is difficult to perform, and additionally, the physical properties of the obtained monofilament tend to be poor. When the spinning temperature is too low, unmelted matter tends to remain. Then, the spun monofilament is cooled for solidification in a water bath set at 15 to 40° C., and wound up at a rate of 20 to 150 m/min substantially without stretching, to yield a monofilament allowing contrast X-ray radiography.

In the case of the core-sheath type, a compound resin chip composed of a radiopaque agent and a thermoplastic resin is used as the core component and another thermoplastic resin is used as the sheath component. The components are melted respectively in extruders, and melt spinning is performed by using a composite spinning apparatus and by extruding from a spinneret.

Similarly, the spinning temperature is preferably set to fall within a range from (Tm+10)° C. to (Tm+80)° C. in relation to the melting point Tm of the thermoplastic resin used, and it is preferable to select the resins with which the spinning temperature difference between the core portion and the sheath portion falls within a range from 0° C. to 50° C.

The method for producing the core-sheath type is otherwise the same as in the case of the single-component type.

EXAMPLES

Next, the present invention is described in detail with reference to Examples. It is to be noted that the measurements and the evaluations of the values of the properties in following Examples and Comparative Examples were performed as follows.

(A) Relative Viscosity

PET: Measurement was performed by using as a solvent an equal mass mixture composed of phenol and ethane tetrachloride, and by using a Uberode viscometer under the conditions of a sample concentration of 0.5 g/100 cc and a temperature of 20° C.

Nylon 6: Measurement was performed by using as a solvent 96% sulfuric acid and by means of an ordinary method under the conditions of a concentration of 1 g/deciliter and a temperature of 25° C.

(B) Durometer Hardness of Thermoplastic Resin

Measurement was performed according to the JIS K 6253 method, by using a type A and a type D spring type hardness tester (durometer) manufactured by Shore Co., USA, with a 6-mm thick specimen.

The sheath portions of Comparative Examples 5 and 6, the sheath portions of Examples 33 to 44 and the sheath portions of Comparative Examples 8 to 14 were higher in hardness as compared to the sheath portions of the other Comparative Examples and Examples, and hence were not able to be measured accurately with the durometer. Therefore, the Rockwell hardness was measured, according to the JIS K 7202 method, by using a Rockwell hardness tester M434H-27P manufactured by Future-Tech Corp., with a 6-mm thick specimen.

Also for the case where the sheath-portion thermoplastic resin of the core-sheath monofilament was nylon 12 or PET, the Rockwell hardness was measured in the same manner.

(C) Strength, Elongation and Young's Modulus of Monofilament Allowing Contrast X-ray Radiography The strength and the elongation were measured by using Autograph AGS-500A manufactured by Shimadzu Corp., under the conditions of a specimen length of 250 mm and a tensile speed of 300 mm/min.

The Young's modulus was calculated by using the values of the strength and the elongation.

(D) Fineness of Monofilament Allowing Contrast X-ray Radiography

Measurement was performed according to the A method for fineness based on corrected weight described in JIS L 1013.

(E) Contrast Capability of Monofilament Allowing Contrast X-ray Radiography

An X-ray photograph of a non-woven fabric using a monofilament allowing contrast X-ray radiography was taken by using an X-ray generator (anode: tungsten) with a tube voltage of 80 kV and a tube current of 400 mA under the photographing conditions of an X-ray irradiation distance of 1 m and an irradiation time of 0.063 second. Then, the appearance of the monofilament allowing contrast X-ray radiography by visual inspection with the obtained photograph was evaluated according to the following four grades.

E (Excellent): Very clearly visible

G (Good): Clearly visible

F (Fair): Fairly clearly visible

P (Poor): Scarcely visible (F) Touch Feeling of Non-Woven Fabric

The touch feeling of a non-woven fabric obtained by using a monofilament allowing contrast X-ray radiography was evaluated according to the following four grades.

E (Excellent): Soft and suitable as surgical gauze

G (Good): Soft and suitable as surgical gauze, but with a slight feeling of a foreign body F (Fair): Slightly poor in flexibility, with a feeling of a foreign body, but usable as surgical gauze P (Poor): Poor in flexibility (hard) and unusable as surgical gauze (G) Guide Abrasion Evaluation was performed on the basis of the abrasion degree of the surface of the spinning guide disposed in a production apparatus for obtaining a composite monofilament. Specifically, the abrasion degree of the surface of the spinning guide after 24-hour continuous operation was evaluated by visual inspection according to the following three grades.

G (Good): Almost no guide abrasion is caused.

F (Fair): Slight guide abrasion is caused.

P (Poor): Considerable guide abrasion is caused.

(H) Surface Asperities of Monofilament Allowing Contrast X-Ray Radiography

The surface of a composite monofilament was photographed, and the presence/absence of the surface asperities was determined by visual inspection with an enlarged picture of the photograph, and evaluated according to the following three grades.

G (Good): Almost no surface asperities were caused.

F (Fair): Slight surface asperities were caused.

P (Poor): Considerable surface asperities were caused.

Examples and Comparative Examples of Single-Component Monofilament

Example 1

As shown in Table 1, a polyester elastomer (Hytrel SB704, durometer hardness: A70, manufactured by Du Pont-Toray Co., Ltd.) having a melt flow rate (MFR) value of 33 g/10 min (temperature: 220° C., load: 10 kg) according to the ASTM D-1238 method was used as a thermoplastic resin. Barium sulfate was used as a radiopaque agent. A compound resin chip prepared so as for the content of barium sulfate in a monofilament to be 35% by mass was fed to a melt extruder and melt spinning was performed. Melting was performed at a spinning temperature of 225° C., discharging was performed from a spinneret having spinning pores of 3.0 mm in pore size, cooling for solidification was performed with a water bath set at 20° C., winding up was performed at a winding-up rate of 20 m/min substantially without stretching, and thus a single-component monofilament allowing contrast X-ray radiography of 3800 dtex/1f was obtained.

A melt-spun cellulose fiber ("Lenzing Lyocell," registered trademark of Lenzing AG, single yarn fineness: 1.7 dtex, fiber length: 38 mm) was subjected to opening with a random card, and thus a fiber web of 15 g/m$^2$ was obtained.

On this fiber web, the monofilament allowing contrast X-ray radiography obtained as described above was disposed at an interval of 100 mm in the web flow direction (longitudinal direction) so as to be arranged linearly in the transverse direction of the web. On the fiber web thus treated, another fiber web, of 15 g/m$^2$, the same as the above-obtained fiber web was laminated to prepare a laminate. Then, the obtained laminate was placed on the mesh-shaped support having a mesh of 100, and was twice subjected to a high-pressure water jet treatment at a jet pressure of 6.9 MPa, by using a jet device having jet pores of 0.1 mm in nozzle pore size, arranged transversely in one row with a pore interval of 0.6 mm. Then, the laminate was reversed and thus the opposite side was twice subjected to a high-pressure water jet treatment at a jet pressure of 9.8 MPa. Then, the superfluous water was removed, a drying treatment with a dryer set at 130° C. was performed, and thus a non-woven fabric was obtained.

Examples 2 to 5 and Comparative Examples 1 and 2

In each of these Examples and Comparative Examples, as compared to Example 1, the content of barium sulfate in a monofilament was altered so as to be the value shown in Table 1 or 2, and a single-component monofilament allowing contrast X-ray radiography was obtained otherwise in the same manner as in Example 1; then, a non-woven fabric was obtained in the same manner as in Example 1, by using the obtained monofilament allowing contrast X-ray radiography.

Examples 6 to 8

In each of these Examples, as shown in Table 1, a polyester elastomer (Hytrel SB 754, durometer hardness: A75, manufactured by Du Pont-Toray Co., Ltd.) having an MFR value of 98 g/10 min (temperature 220° C., load: 10 kg) according to the ASTM D-1238 method was used as a thermoplastic resin, and a compound resin chip prepared so as for the content of barium sulfate in a monofilament to be the value shown in Table 1 was used; otherwise in the same manner as in Example 1, a single-component monofilament allowing contrast X-ray radiography was obtained; and by using the obtained monofilament allowing contrast X-ray radiography, a non-woven fabric was obtained in the same manner as in Example 1.

Examples 9 to 11

In each of these Examples, as shown in Table 1, a polyester elastomer (Hytrel 3046, durometer hardness: D27, manufactured by Du Pont-Toray Co., Ltd.) having an MFR value of 10 g/10 min (temperature 190° C., load: 2.16 kg) according to the ASTM D-1238 method was used as a thermoplastic resin, and a compound resin chip prepared so as for the content of barium sulfate in a monofilament to be the value shown in Table 1 was used; otherwise in the same manner as in Example 1, a single-component monofilament allowing contrast X-ray radiography was obtained; and by using the obtained monofilament allowing contrast X-ray radiography, a non-woven fabric was obtained in the same manner as in Example 1.

Examples 12 to 14

In each of these Examples, as shown in Table 1, a polyester elastomer (Hytrel 4767, durometer hardness: D47, manufactured by Du Pont-Toray Co., Ltd.) having an MFR value of 18 g/10 min (temperature 220° C., load: 2.16 kg) according to the ASTM D-1238 method was used as a thermoplastic resin, and a compound resin chip prepared so as for the content of barium sulfate in a monofilament to be the value shown in Table 1 was used, and melting was performed at a spinning temperature of 240° C.; otherwise in the same manner as in Example 1, a single-component monofilament allowing contrast X-ray radiography was obtained; and by using the obtained monofilament allowing contrast X-ray radiography, a non-woven fabric was obtained in the same manner as in Example 1.

Examples 15 to 19 and Comparative Examples 3 and 4

In each of these Examples and Comparative Examples, the content of barium sulfate in a monofilament and the fineness of the monofilament were altered so as to be the values shown in Table 1 or 2; otherwise in the same manner as in Example 1, a single-component monofilament allowing contrast X-ray radiography was obtained; and by using the obtained monofilament allowing contrast X-ray radiography, a non-woven fabric was obtained in the same manner as in Example 1.

Examples 20 to 24

In each of these Examples, the content of barium sulfate in a monofilament and the fineness of the monofilament were altered so as to be the values shown in Table 1; otherwise in the same manner as in Example 9, a single-component monofilament allowing contrast X-ray radiography was obtained; and by using the obtained monofilament allowing contrast X-ray radiography, a non-woven fabric was obtained in the same manner as in Example 1.

Examples 25 and 26

The X-ray opaque agent was altered to bismuth subnitrate (Example 25) and to tungsten oxide (Example 26). Each of the contents of these, in a monofilament, was set so as to be the value shown in Table 1. In each of Examples 25 and 26, otherwise in the same manner as in Example 1, a single-component monofilament allowing contrast X-ray radiography was obtained, and by using the obtained monofilament allowing contrast X-ray radiography, a non-woven fabric was obtained in the same manner as in Example 1.

Examples 27 to 29

In each of these Examples, as shown in Table 1, a polyamide elastomer (Pebax 3533SN01, durometer hardness: D33, manufactured by Arkema Inc.) having an MFR value of 10 g/10 min (temperature 230° C., load: 2.16 kg) according to the ASTM D-1238 method was used as a thermoplastic resin, and a compound resin chip prepared so as for the content of barium sulfate in a monofilament to be the value shown in Table 1 was used, and melting was performed at a spinning temperature of 210° C.; otherwise in the same manner as in Example 1, a single-component monofilament allowing contrast X-ray radiography was obtained; and by using the obtained monofilament allowing contrast X-ray radiography, a non-woven fabric was obtained in the same manner as in Example 1.

Examples 30 to 32

In each of these Examples, as shown in Table 1, a polyamide elastomer (Pebax 533SN01, durometer hardness: D55, manufactured by Arkema Inc.) having an MFR value of 8 g/10 min (temperature 230° C., load: 2.16 kg) according to the ASTM D-1238 method was used as a thermoplastic resin, and a compound resin chip prepared so as for the content of barium sulfate in a monofilament to be the value shown in Table 1 was used, and melting was performed at a spinning temperature of 220° C.; otherwise in the same manner as in Example 1, a single-component monofilament allowing contrast X-ray radiography was obtained; and by using the obtained monofilament allowing contrast X-ray radiography, a non-woven fabric was obtained in the same manner as in Example 1.

Comparative Example 5

As shown in Table 2, a polyethylene terephthalate (PET, Rockwell hardness: R120) having a relative viscosity of 1.37 was used as a thermoplastic resin. A compound resin chip prepared so as for the content of barium sulfate in a monofilament to be 60% by mass was fed to a melt extruder and melt spinning was performed. Specifically, melting was performed at a spinning temperature of 260° C., discharging was performed from a spinneret having spinning pores of 3.0 mm in pore size, cooling for solidification was performed with a water bath set at 20° C., winding up was performed at a winding-up rate of 40 m/min substantially without stretching, and thus a single-component monofilament allowing contrast X-ray radiography of 3800 dtex/1f was obtained. And, by using the obtained monofilament, a non-woven fabric was obtained in the same manner as in Example 1.

Comparative Example 6

As shown in Table 2, nylon 6 (Rockwell hardness: R110) having a relative viscosity of 2.4 was used as a thermoplastic resin. A compound resin chip prepared so as for the content of barium sulfate in a monofilament to be 60% by mass was fed to a melt extruder and melt spinning was performed. Specifically, melting was performed at a spinning temperature of 260° C., discharging was performed from a spinneret having spinning pores of 3.0 mm in pore size, cooling for solidification was performed with a water bath set at 20° C., winding up was performed at a winding-up rate of 40 m/min substantially without stretching, and thus a single-component monofilament allowing contrast X-ray radiography of 3800 dtex/1f was obtained. And, by using the obtained monofilament, a non-woven fabric was obtained in the same manner as in Example 1.

Tables 1 and 2 show the evaluation results of the single-component monofilaments allowing contrast X-ray radiography and the non-woven fabrics of Examples 1 to 32 and Comparative Examples 1 to 6.

TABLE 1

| | Thermoplastic resin | | X-ray opaque agent | | | | | Young's | | |
|---|---|---|---|---|---|---|---|---|---|---|
| | Type | Durometer hardness | Type | Content (% by mass) | Fineness (dtex) | Strength (CN/dtex) | Elongation (%) | modulus (CN/dtex) | Touch feeling | Contrast capability |
| Example 1 | Polyester | A70 | $BaSO_4$ | 35 | 3800 | 0.04 | 73 | 0.31 | E | F |
| Example 2 | elastomer | | | 50 | | 0.04 | 53 | 0.42 | E | G |

TABLE 1-continued

| | Thermoplastic resin | | X-ray opaque agent | | | | | Young's | | |
|---|---|---|---|---|---|---|---|---|---|---|
| | Type | Durometer hardness | Type | Content (% by mass) | Fineness (dtex) | Strength (CN/dtex) | Elongation (%) | modulus (CN/dtex) | Touch feeling | Contrast capability |
| Example 3 | | | | 60 | | 0.03 | 30 | 0.79 | E | E |
| Example 4 | | | | 70 | | 0.03 | 24 | 1.25 | G | E |
| Example 5 | | | | 80 | | 0.02 | 19 | 2.06 | G | E |
| Example 6 | | A75 | | 50 | | 0.05 | 70 | 0.41 | E | G |
| Example 7 | | | | 60 | | 0.04 | 55 | 0.52 | E | E |
| Example 8 | | | | 70 | | 0.04 | 42 | 0.61 | E | E |
| Example 9 | | D27 | | 50 | | 0.09 | 873 | 0.62 | E | G |
| Example 10 | | | | 60 | | 0.07 | 774 | 1.06 | G | E |
| Example 11 | | | | 70 | | 0.06 | 463 | 1.47 | G | E |
| Example 12 | | D47 | | 50 | | 0.08 | 762 | 1.14 | G | G |
| Example 13 | | | | 60 | | 0.06 | 631 | 1.55 | G | E |
| Example 14 | | | | 70 | | 0.05 | 446 | 1.91 | G | E |
| Example 15 | | A70 | | 60 | 520 | 0.03 | 61 | 0.92 | E | G |
| Example 16 | | | | 60 | 1300 | 0.04 | 68 | 1.08 | E | G |
| Example 17 | | | | 60 | 7600 | 0.03 | 42 | 1.10 | G | E |
| Example 18 | | | | 60 | 12000 | 0.03 | 51 | 1.93 | G | E |
| Example 19 | | | | 60 | 19500 | 0.04 | 73 | 1.63 | F | E |
| Example 20 | | D27 | | 60 | 510 | 0.07 | 589 | 0.95 | E | G |
| Example 21 | | | | 60 | 1200 | 0.07 | 627 | 0.84 | E | G |
| Example 22 | | | | 60 | 7600 | 0.06 | 863 | 1.01 | G | E |
| Example 23 | | | | 60 | 12000 | 0.06 | 832 | 1.10 | G | E |
| Example 24 | | | | 60 | 19800 | 0.07 | 683 | 0.92 | F | E |
| Example 25 | | A70 | Bismuth subnitrate | 50 | 3800 | 0.04 | 68 | 0.49 | E | G |
| Example 26 | | | Tungsten oxide | 50 | | 0.04 | 76 | 0.48 | E | G |
| Example 27 | Polyamide elastomer | D33 | $BaSO_4$ | 50 | | 0.07 | 679 | 0.98 | E | G |
| Example 28 | | | | 60 | | 0.06 | 596 | 1.32 | G | E |
| Example 29 | | | | 70 | | 0.05 | 493 | 1.69 | G | E |
| Example 30 | | D55 | | 50 | | 0.07 | 599 | 1.35 | G | G |
| Example 31 | | | | 60 | | 0.06 | 613 | 1.87 | G | E |
| Example 32 | | | | 70 | | 0.05 | 567 | 2.31 | G | E |

TABLE 2

| | Thermoplastic resin | | X-ray opaque agent | | | | | Young's | | |
|---|---|---|---|---|---|---|---|---|---|---|
| | Type | Durometer hardness | Type | Content (% by mass) | Fineness (dtex) | Strength (CN/dtex) | Elongation (%) | modulus (CN/dtex) | Touch feeling | Contrast capability |
| Comparative Example 1 | Polyester elastomer | A70 | $BaSO_4$ | 20 | 3800 | 0.04 | 81 | 0.36 | E | P |
| Comparative Example 2 | | | | 85 | | 0.02 | 21 | 3.01 | P | E |
| Comparative Example 3 | | | | 60 | 480 | 0.03 | 42 | 0.51 | E | P |
| Comparative Example 4 | | | | 60 | 22000 | 0.03 | 68 | 3.12 | P | E |
| Comparative Example 5 | Polyethylene terephthalate | Rockwell hardness R120 | | 60 | 3800 | 1.36 | 278 | 13.5 | P | E |
| Comparative Example 6 | Nylon 6 | Rockwell hardness R110 | | 60 | | 1.15 | 363 | 8.61 | P | E |

As is clear from Table 1, the single-component monofilaments allowing contrast X-ray radiography of Examples 1 to 32 each had a Young's modulus falling within the range of the present invention, and were excellent in flexibility. The non-woven fabrics obtained by using these monofilaments had soft texture, were suitably usable as surgical gauze, and were excellent in X-ray contrast performance.

On the other hand, as is clear from Table 2, the following results were obtained. The single-component monofilament allowing contrast X-ray radiography of Comparative Example 1 had a too small content of barium sulfate in the monofilament, and the single-component monofilament allowing contrast X-ray radiography of Comparative Example 3 had a too low fineness of the monofilament, and hence both of these single-component monofilaments were poor in contrast capability. The single-component monofilament allowing contrast X-ray radiography of Comparative Example 2 had a too large content of barium sulfate in the monofilament, and the single-component monofilament allowing contrast X-ray radiography of Comparative Example 4 had a too high fineness of the monofilament, and hence both of these single-component monofilaments were poor in flexibility; consequently, the obtained non-woven fabrics were hard and unsuitable as surgical gauze. The single-component monofilaments allowing contrast X-ray radiography of Comparative Examples 5 and 6 each used a thermoplastic resin having a durometer hardness of D70 or more, and hence were too high in Young's modulus and poor in flexibility; consequently, the obtained non-woven fabrics were hard and unsuitable as surgical gauze.

Examples and Comparative Examples of Core-sheath Monofilament

Example 33

As shown in Table 3, the same polyester elastomer (Hytrel 3046, durometer hardness: D27, manufactured by Du Pont-Toray Co., Ltd.) as used in Example 9 was used as a core-portion thermoplastic resin, the polyester elastomer having an MFR value of 10 g/10 min (temperature: 190° C., load: 2.16 kg) according to the ASTM D-1238 method. Barium sulfate was used as a radiopaque agent. A compound resin chip was prepared so as for the content of barium sulfate in the core-portion thermoplastic resin to be 35% by mass.

As a sheath-portion thermoplastic resin, nylon 12 (L1901, Rockwell hardness: R110, manufactured by Daicel-Degussa Ltd.) having a relative viscosity of 1.90 was used.

These thermoplastic resins were respectively fed to melt extruders so as for the core-sheath ratio (volume ratio) to be 2/1, and melt spinning was performed by using a composite spinning apparatus. In this spinning, melting was performed at a spinning temperature of 220° C., and discharging was performed from a spinneret having spinning pores of 2.0 mm in pore size. The spun monofilament was cooled for solidification in a water bath set at 20° C., guided to a roller through a spinning guide, wound up at a winding-up rate of 40 m/min substantially without stretching, and thus a core-sheath composite monofilament allowing contrast X-ray radiography of 3800 dtex/1f was obtained.

Then, by using the obtained core-sheath composite monofilament allowing contrast X-ray radiography, a non-woven fabric was obtained in the same manner as in Example 1.

Examples 34 to 42 and Comparative Examples 7 to 12

In each of these Examples and Comparative Examples, as compared to Example 33, the content of barium sulfate in a core-portion thermoplastic resin, the core-sheath ratio (volume ratio) and the fineness of a monofilament were altered so as to be the values shown in Table 3 or 4; otherwise in the same manner as in Example 33, a core-sheath composite monofilament allowing contrast X-ray radiography was obtained.

Then, by using the obtained core-sheath composite monofilaments allowing contrast X-ray radiography, non-woven fabrics were obtained in the same manner as in Example 1.

Example 43

The same polyester elastomer (Hytrel SB754, durometer hardness: A75, manufactured by Du Pont-Toray Co., Ltd.) as used in Example 6 was used as a core-portion thermoplastic resin, the polyester elastomer having an MFR value of 98 g/10 min (temperature: 220° C., load: 10 kg) according to the ASTM D-1238 method. Barium sulfate was used as a radiopaque agent. A compound resin chip was prepared so as for the content of barium sulfate in the core-portion thermoplastic resin to be 60% by mass.

The same nylon 12 as used in Example 33 was used as a sheath-portion thermoplastic resin, and the core-sheath ratio (volume ratio) was set to be 2/1. Otherwise in the same manner as in Example 33, a core-sheath composite monofilament allowing contrast X-ray radiography of 7100 dtex/1f was obtained.

Then, by using the obtained core-sheath composite monofilament allowing contrast X-ray radiography, a non-woven fabric was obtained in the same manner as in Example 1.

Example 44

As compared to Example 43, the core-sheath ratio (volume ratio) and the fineness were altered so as to be the values shown in Table 3. Otherwise in the same manner as in Example 43, a core-sheath composite monofilament allowing contrast X-ray radiography of 7603 dtex/1f was obtained.

Then, by using the obtained core-sheath composite monofilament allowing contrast X-ray radiography, a non-woven fabric was obtained in the same manner as in Example 1.

Example 45

A polyester elastomer (Hytrel 3046, durometer hardness: D27, manufactured by Du Pont-Toray Co., Ltd.) having an MFR value of 10 g/10 min (temperature 190° C., load: 2.16 kg) according to the ASTM D-1238 method was used as a sheath-portion thermoplastic resin. The core-sheath ratio (volume ratio) was set to be 2/1, and the fineness of the monofilament was set to be the value shown in Table 3. Otherwise under the same conditions as in Example 33 inclusive of, for example, the core-portion thermoplastic resin and other conditions, a core-sheath composite monofilament allowing contrast X-ray radiography was obtained.

Then, by using the obtained core-sheath composite monofilament allowing contrast X-ray radiography, a non-woven fabric was obtained in the same manner as in Example 1.

Example 46

As compared to Example 45, the core-sheath ratio (volume ratio) and the fineness of the monofilament were altered so as to be the values shown in Table 3. Otherwise in the same manner as in Example 45, a core-sheath composite monofilament allowing contrast X-ray radiography was obtained.

Then, by using the obtained core-sheath composite monofilament allowing contrast X-ray radiography, a non-woven fabric was obtained in the same manner as in Example 1.

Example 47

A polyester elastomer (Hytrel SB754, durometer hardness: A75, manufactured by Du Pont-Toray Co., Ltd.) having an MFR value of 98 g/10 min (temperature: 220° C., load: 10 kg)

according to the ASTM D-1238 method was used as a sheath-portion thermoplastic resin. The core-sheath ratio (volume ratio), the content of barium sulfate in the core-portion thermoplastic resin and the fineness of the monofilament were altered so as to be the values shown in Table 2. Otherwise under the same conditions as in Example 33 inclusive of, for example, the core-portion thermoplastic resin and other conditions, a core-sheath composite monofilament allowing contrast X-ray radiography was obtained.

Then, by using the obtained core-sheath composite monofilament allowing contrast X-ray radiography, a non-woven fabric was obtained in the same manner as in Example 1.

Example 48

As compared to Example 47, the core-sheath ratio (volume ratio) and the fineness were altered so as to be the values shown in Table 3. Otherwise in the same manner as in Example 47, a core-sheath composite monofilament allowing contrast X-ray radiography was obtained.

Then, by using the obtained core-sheath composite monofilament allowing contrast X-ray radiography, a non-woven fabric was obtained in the same manner as in Example 1.

Example 49

As a sheath-portion thermoplastic resin, used was a compound (the durometer hardness of the compound product: D47) prepared by kneading a polyester elastomer (Hytrel 3046, durometer hardness: D27, manufactured by Du Pont-Toray Co., Ltd.) having an MFR value of 10 g/10 min (temperature 190° C., load: 2.16 kg) according to the ASTM D-1238 method and a polyester elastomer (Hytrel 7277, durometer hardness: D72, manufactured by Du Pont-Toray Co., Ltd.) having an MFR value of 1.5 g/10 min (temperature 240° C., load: 2.16 kg) according to the ASTM D-1238 method, in a mass ratio of (Hytrel 3046):(Hytrel 7277)=7:3. The fineness of the monofilament was altered so as to be the value shown in Table 3. Otherwise under the same conditions as in Example 45 inclusive of, for example, the core-portion thermoplastic resin and other conditions, a core-sheath composite monofilament allowing contrast X-ray radiography was obtained. Then, by using the obtained core-sheath composite monofilament allowing contrast X-ray radiography, a non-woven fabric was obtained in the same manner as in Example 1.

Examples 50 to 54

In each of these Examples, as compared to Example 49, the fineness was altered to be the value shown in Table 3; otherwise in the same manner as in Example 49, a core-sheath composite monofilament allowing contrast X-ray radiography was obtained; and then, by using the obtained core-sheath composite monofilament allowing contrast X-ray radiography, a non-woven fabric was obtained in the same manner as in Example 1.

Example 55

As a sheath-portion thermoplastic resin, used was a compound (the durometer hardness of the compound product: D55) prepared by kneading a polyester elastomer (Hytrel 3046, durometer hardness: D27, manufactured by Du Pont-Toray Co., Ltd.) having an MFR value of 10 g/10 min (temperature 190° C., load: 2.16 kg) according to the ASTM D-1238 method and a polyester elastomer (Hytrel 7277, durometer hardness: D72, manufactured by Du Pont-Toray Co., Ltd.) having an MFR value of 1.5 g/10 min (temperature 240° C., load: 2.16 kg) according to the ASTM D-1238 method, in a mass ratio of 5:5. The fineness of the monofilament was altered so as to be the value shown in Table 3. Otherwise under the same conditions as in Example 45 inclusive of, for example, the core-portion thermoplastic resin and other conditions, a core-sheath composite monofilament allowing contrast X-ray radiography was obtained. Then, by using the obtained core-sheath composite monofilament allowing contrast X-ray radiography, a non-woven fabric was obtained in the same manner as in Example 1.

Example 56

As a sheath-portion thermoplastic resin, used was a compound (the durometer hardness of the compound product: D63) prepared by kneading a polyester elastomer (Hytrel 3046, durometer hardness: D27, manufactured by Du Pont-Toray Co., Ltd.) having an MFR value of 10 g/10 min (temperature 190° C., load: 2.16 kg) according to the ASTM D-1238 method and a polyester elastomer (Hytrel 7277, durometer hardness: D72, manufactured by Du Pont-Toray Co., Ltd.) having an MFR value of 1.5 g/10 min (temperature 240° C., load: 2.16 kg) according to the ASTM D-1238 method, in a mass ratio of (Hytrel 3046):(Hytrel 7277)=3:7. The fineness of the monofilament was altered so as to be the value shown in Table 3. Otherwise under the same conditions as in Example 45 inclusive of, for example, the core-portion thermoplastic resin and other conditions, a core-sheath composite monofilament allowing contrast X-ray radiography was obtained. Then, by using the obtained core-sheath composite monofilament allowing contrast X-ray radiography, a non-woven fabric was obtained in the same manner as in Example 1.

Comparative Example 13

As compared to Example 33, a PET (Rockwell hardness: R120) having a relative viscosity of 1.37 was used as a sheath-portion thermoplastic resin, the spinning temperature was set at 260° C., and the core-sheath ratio (volume ratio), the content of barium sulfate in a core-portion thermoplastic resin and the fineness of a monofilament were altered to be the values shown in Table 4. Otherwise in the same manner as in Example 33, a core-sheath composite monofilament allowing contrast X-ray radiography was obtained.

Then, by using the obtained core-sheath composite monofilament allowing contrast X-ray radiography, a non-woven fabric was obtained in the same manner as in Example 1.

Tables 3 and 4 show the evaluation results of the core-sheath composite monofilaments allowing contrast X-ray radiography and the non-woven fabrics of Examples 33 to 56 and Comparative Examples 7 to 13.

TABLE 3

| | Core-portion thermoplastic resin | | Sheath-portion thermoplastic resin | | Core-sheath ratio (volume ratio) | | Radiopaque agent | |
|---|---|---|---|---|---|---|---|---|
| | Type | Durometer hardness | Type | Durometer hardness | Core | Sheath | Type | Content (% by mass) |
| Example 33 | Polyester elastomer | D27 | Nylon 12 | Rockwell hardness R110 | 2 | 1 | $BaSO_4$ | 35 |
| Example 34 | | | | | 2 | 1 | | 50 |
| Example 35 | | | | | 1 | 1 | | 60 |
| Example 36 | | | | | 2 | 1 | | 65 |
| Example 37 | | | | | 3 | 1 | | 60 |
| Example 38 | | | | | 4 | 1 | | 60 |
| Example 39 | | | | | 2 | 1 | | 70 |
| Example 40 | | | | | 3 | 1 | | 70 |
| Example 41 | | | | | 2 | 1 | | 40 |
| Example 42 | | | | | 2 | 1 | | 75 |
| Example 43 | | A75 | | | 2 | 1 | | 60 |
| Example 44 | | | | | 3 | 1 | | 60 |
| Example 45 | | D27 | Polyester elastomer | D27 | 2 | 1 | | 60 |
| Example 46 | | | | | 3 | 1 | | 60 |
| Example 47 | | | | A75 | 2 | 1 | | 65 |
| Example 48 | | | | | 3 | 1 | | 65 |
| Example 49 | | | | D47 (D27/D72 = 7/3 (Mass ratio)) | 2 | 1 | | 60 |
| Example 50 | | | | | 2 | 1 | | 60 |
| Example 51 | | | | | 2 | 1 | | 60 |
| Example 52 | | | | | 2 | 1 | | 60 |
| Example 53 | | | | | 2 | 1 | | 60 |
| Example 54 | | | | | 2 | 1 | | 60 |
| Example 55 | | | | D55 (D27/D72 = 5/5) | 2 | 1 | | 60 |
| Example 56 | | | | D63 (D27/D72 = 3/7) | 2 | 1 | | 60 |

| | Fineness (dtex) | Young's modulus (CN/dtex) | Touch feeling | Contrast capability | Guide abrasion | Surface asperities |
|---|---|---|---|---|---|---|
| Example 33 | 3800 | 1.6 | G | F | G | G |
| Example 34 | 3800 | 1.9 | G | G | G | G |
| Example 35 | 3415 | 3.4 | G | G | G | G |
| Example 36 | 5020 | 2.1 | G | E | G | G |
| Example 37 | 5410 | 1.5 | G | E | G | G |
| Example 38 | 5805 | 0.9 | E | E | G | G |
| Example 39 | 5510 | 2.3 | G | E | G | G |
| Example 40 | 6403 | 1.6 | G | E | G | G |
| Example 41 | 2915 | 1.9 | G | G | G | G |
| Example 42 | 6815 | 2.2 | G | E | G | G |
| Example 43 | 7100 | 1.6 | G | E | G | G |
| Example 44 | 7603 | 1.1 | E | E | G | G |
| Example 45 | 8301 | 0.4 | E | E | G | G |
| Example 46 | 9105 | 0.5 | E | E | G | G |
| Example 47 | 15004 | 0.4 | G | E | G | G |
| Example 48 | 17789 | 0.3 | G | E | G | G |
| Example 49 | 510 | 0.6 | E | G | G | G |
| Example 50 | 1024 | 0.6 | E | G | G | G |
| Example 51 | 3800 | 0.6 | E | G | G | G |
| Example 52 | 7002 | 0.6 | E | E | G | G |
| Example 53 | 12006 | 0.6 | G | E | G | G |
| Example 54 | 19054 | 0.6 | G | E | G | G |
| Example 55 | 7008 | 0.9 | E | E | G | G |
| Example 56 | 7013 | 1.3 | E | E | G | G |

TABLE 4

| | Core-portion thermoplastic resin | | Sheath-portion thermoplastic resin | | Core-sheath ratio (volume ratio) | | Radiopaque agent | |
|---|---|---|---|---|---|---|---|---|
| | Type | Durometer hardness | Type | Durometer hardness | Core | Sheath | Type | Content (% by mass) |
| Comparative Example 7 | Polyester elastomer | D27 | Nylon 12 | Rockwell hardness R110 | 1 | 2 | $BaSO_4$ | 65 |
| Comparative Example 8 | | | | | 1 | 3 | | 60 |

TABLE 4-continued

| | | | | | | |
|---|---|---|---|---|---|---|
| Comparative Example 9 | | | 1 | 1 | | 60 |
| Comparative Example 10 | | | 1 | 1 | | 60 |
| Comparative Example 11 | | | 1 | 1 | | 25 |
| Comparative Example 12 | | | 1 | 1 | | 82 |
| Comparative Example 13 | PET | Rockwell hardness R120 | 1 | 2 | | 60 |

| | Fineness (dtex) | Young's modulus (CN/dtex) | Touch feeling | Contrast capability | Guide abrasion | Surface asperities |
|---|---|---|---|---|---|---|
| Comparative Example 7 | 4312 | 7.6 | P | F | G | G |
| Comparative Example 8 | 3514 | 9.2 | P | P | G | G |
| Comparative Example 9 | 480 | 3.1 | G | P | G | G |
| Comparative Example 10 | 20106 | 3.4 | P | E | G | G |
| Comparative Example 11 | 7001 | 2.8 | G | P | G | G |
| Comparative Example 12 | 16006 | 5.4 | P | E | G | G |
| Comparative Example 13 | 3718 | 11.3 | P | P | G | G |

As is clear form Table 3, the core-sheath composite monofilaments allowing contrast X-ray radiography of Examples 33 to 56 each had a Young's modulus falling within the range of the present invention, and were thereby excellent in flexibility and were highly evaluated both in touch feeling and in contrast capability. Therefore, the obtained non-woven fabrics had soft texture, and were suitably usable as surgical gauze. Additionally, the core-sheath composite monofilaments allowing contrast X-ray radiography were very scarce in surface asperities and very low in guide abrasion.

On the other hand, the core-sheath composite monofilaments allowing contrast X-ray radiography of Comparative Examples 7, 8 and 13 each had a large volume ratio of the sheath portion and each also had a high Young's modulus, and hence were poor in flexibility, low in touch feeling evaluation and poor in contrast capability. The core-sheath composite monofilament allowing contrast X-ray radiography of Comparative Example 9 had a fineness of less than 500 dtex, and the core-sheath composite monofilament allowing contrast X-ray radiography of Comparative Example 11 had a content of barium sulfate in the core portion less than 30% by mass, and hence both of these core-sheath composite monofilaments were poor in contrast capability. The core-sheath composite monofilament allowing contrast X-ray radiography of Comparative Example 10 had a fineness exceeding 20000 dtex, and hence was thick in monofilament size and poor in flexibility. The core-sheath composite monofilament allowing contrast X-ray radiography of Comparative Example 12 had a content of barium sulfate in the core portion exceeding 80% by mass, and hence was poor in flexibility and also poor in spinning operability.

Therefore, the monofilaments of Comparative Examples 7 to 13 were all unsuitable for being used as surgical gauze.

The invention claimed is:

1. A radiopaque monofilament characterized in that at least part of the monofilament is formed of an elastomer containing 30 to 80% by mass of a radiopaque agent and having a durometer hardness of less than D70 according to a JIS K6253 method, and wherein the monofilament has a Young's modulus of 0.1 to 5.0 cN/dtex and a fineness of 500 to 20000 dtex.

2. The radiopaque monofilament according to claim 1, wherein the monofilament is a single-component monofilament formed only of the elastomer.

3. The radiopaque monofilament according to claim 1, wherein the monofilament has a cross sectional shape of core-sheath structure and a core portion is formed of the elastomer.

4. The radiopaque monofilament according to claim 3, wherein the durometer hardness of the elastomer for the core portion, according to the JIS K6253 method, is less than D60.

* * * * *